United States Patent [19]

Bannister

[11] 4,332,379

[45] Jun. 1, 1982

[54] COLLAPSIBLE EXERCISE BACK PACK

[76] Inventor: Clifford R. Bannister, 2801 Treehouse Pkwy., Norcross, Ga. 30093

[21] Appl. No.: 172,814

[22] Filed: Jul. 28, 1980

[51] Int. Cl.[3] ..... A63B 21/12

[52] U.S. Cl. ..... 272/119; 224/215

[58] Field of Search ..... 272/119, 130, 117, 93, 272/71, 70; 224/153, 215, 216; 220/20, 20.5, 22, 23.8, 150; 150/0.5, 1

[56] References Cited

U.S. PATENT DOCUMENTS

| | | | |
|---|---|---|---|
| 432,607 | 7/1890 | Dwyer | 224/153 |
| 447,669 | 3/1891 | Dwyer | 224/153 |
| 2,428,795 | 10/1947 | Frazee | 224/153 |
| 4,096,978 | 6/1978 | Noice | 224/215 |
| 4,236,657 | 12/1980 | Brunton | 224/153 |

FOREIGN PATENT DOCUMENTS

| | | | |
|---|---|---|---|
| 218063 | 7/1967 | Sweden | 272/119 |

*Primary Examiner*—Richard C. Pinkham
*Assistant Examiner*—William R. Browne
*Attorney, Agent, or Firm*—Jones & Askew

[57] ABSTRACT

A collapsible training device to be worn by a person during physical exercise. The device includes a flexible weight carrying member, with at least one opening in the member positioned at its bottom for containing a flexible weight member. Straps attached to the weight carrying member secures the device about the person's shoulders and waist. The flexible weight member is adapted for containing a flexible and disposable weight material. When the weight member is empty, the device occupies a minimum size and has a reduced weight.

6 Claims, 3 Drawing Figures

COLLAPSIBLE EXERCISE BACK PACK

DESCRIPTION

1. Field

The present invention relates to apparatus for use in physical training, and more particularly, to such apparatus which is wearable as a back pack and which can be collapsed to a minimum size and weight.

2. Background of the Invention

Physical training is currently enjoying great popularity. Jogging, weight lifting, as well as other traditional sports, such as tennis, racket ball, football and the like, have millions of enthusiasts who participate in such sports daily. In order to aid in training for participation in such sports, or merely to improve ones physical condition, many different types of apparatus or devices are known.

One type of training device is a garment incorporating a weight therein. Such device are disclosed in British Pat. No. 5,960 and Swedish Pat. No. 218,063, both incorporated herein by reference. The devices shown in these patents, however, have not been commercially successful, perhaps in part, because of their obvious bulk, inflexibility and discomfort while wearing.

SUMMARY OF THE INVENTION

The present invention relates to a back pack which is worn during physical exercise to improve the effectiveness of one's physical training. More particularly, the present invention comprises a flexible weight carrying member which defines a first compartment. A closable opening is provided into the first compartment. Straps are provided for fastening the weight carrying member about the shoulders and waist of the wearer. A flexible weight member which defines a second compartment for containing a flexible and disposable weighting material is adapted to be received in the second compartment. When the weight material is removed, the back pack is collapsible to a minimum size and weight.

Accordingly, it is an object of the present invention to provide an improved physical training device.

Another object of the present invention is to provide a physical training device which is flexible and comfortable to wear during physical exercise.

Yet another object of the present invention is to provide a physical training device which can be weighted with a desired amount of weight to provide varying degrees of physical training and then collapsed to a minimum size and weight after use.

These and other objects, features and advantages of the present invention will become apparent after a review of the following detailed description of the disclosed embodiment and the appended drawing and claims.

DETAILED DESCRIPTION OF THE DISCLOSED EMBODIMENT

Figure 1:
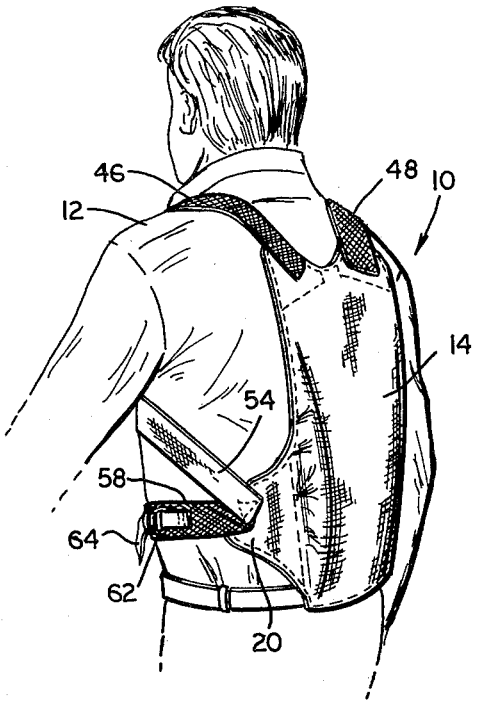
FIG. 1 is a pictorial view of a disclosed embodiment of the physical training device of the present invention showing the device being worn by an individual.
Figure 2:
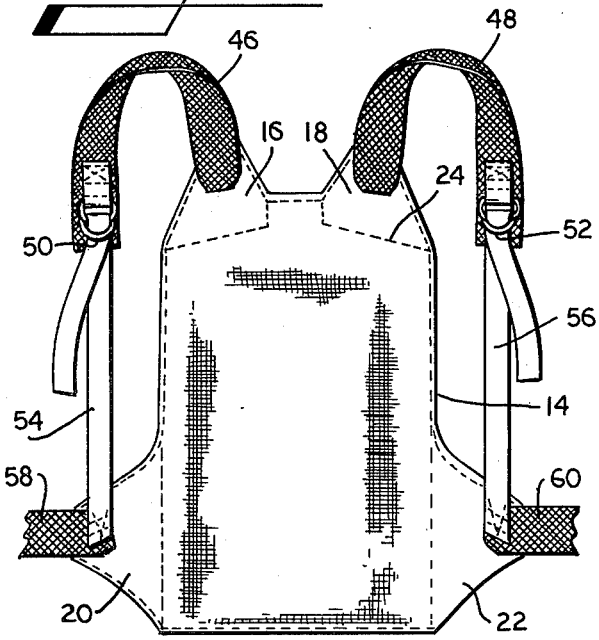
FIG. 2 is a rear view of the device shown in FIG. 1.

Referring now to the drawing in which like numbers indicate like elements throughout the several views, it will be seen that there is a weighted back pack 10 attached to the back of a wearer 12. The back pack includes a generally rectangular weight carrying member 14, a pair of shoulder tabs 16, 18 attached to the upper portion of the weight carrying member and a pair of waist tabs 20, 22 attached to the lower portion of the sides of the weight carrying member. The weight carrying member 14 and the tabs 16–22 must be made out of a strong, flexible material. Additionally, it is desirable that such material be porous or breathable and perspiration absorbent. Suitable materials for constructing the weight carrying member 14 and the tabs 16–22 are canvas or nylon.

Figure 3:
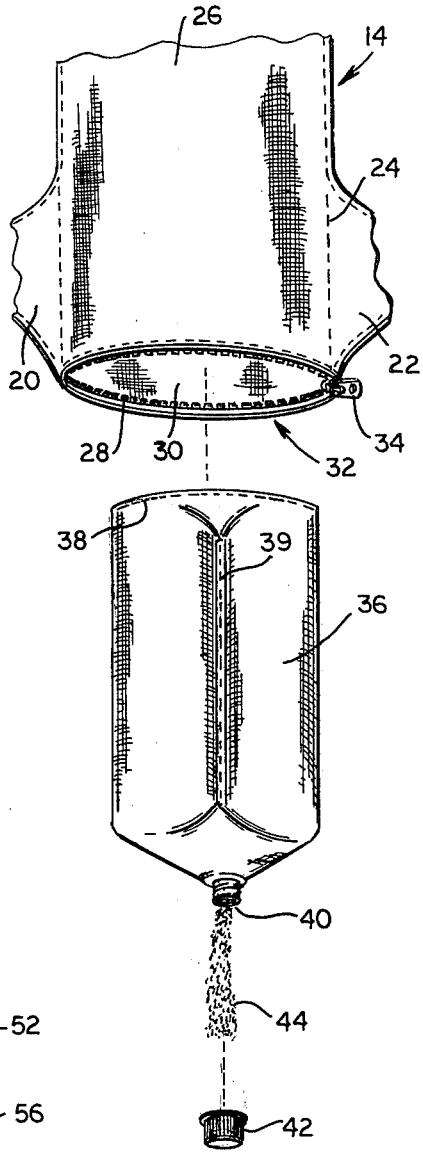
FIG. 3 is a partial rear view of the device shown in FIG. 1 showing the weight member removed from the weight carrying member.

A convenient method for constructing the weight carrying member 14 and the tabs 16–22 is to stitch (such as at 24) two pieces of canvas 26, 28 (FIG. 3) together so that they define a first compartment 30 therebetween and having an opening 32 at the bottom thereof. A conventional zipper 34 or other suitable closure device is provided to selectively close the opening 32.

A flexible weight member 36 (FIG. 3) is similarly constructed from two pieces of canvas stitched together (such as at 38) around the peripheral edge thereof to thereby define a second compartment between the two pieces of canvas. Stitching (such as at 39) can be provided down the center of the weight member 36 so that the second compartment is divided into two communicating subcompartments. A neck opening 40 is provided into the second compartment at one end of the weight member 36. The neck opening 40 is provided with a screw-on cap 42 so that the opening into the second compartment can be selectively closed and opened.

The flexible weight member 36 is filled with a solid, fluid weighting material 44, such as sand, shot or the like, which does not destroy the flexible nature of the weight member. Other materials can also be used for construction of the weight member 36 and for the weighting material 44. For example, the weighting material can be a liquid, such as water, if the flexible weight member 36 is constructed from a suitable flexible and leak-proof material, such as polyvinyl chloride, vinyl and other similar plastics. When water is used as the weighting material, it may be desirable to provide a plurality of dividers in the second compartment of the weight member to thereby provide a plurality of communicating subcompartments in the weight member 36. The dividers would act as reinforcing ribs so that the weight member 36 would hold its shape when filled with water; and furthermore, so that the water would not slosh around excessively when worn, for example, during running. It should be understood that when the weight member 36 is constructed from plastic materials, so as to provide a leak-proof second compartment, the plastic would not be stitched together; but rather, would be glued together. Glues suitable for such purpose are well known in the art.

Attached to the two shoulder tabs 16, 18 respectively are a pair of flexible shoulder straps 46, 48. The shoulder straps 46, 48 are preferably made of a strong material, such as nylon, and are made sufficiently wide so that the weight of the back pack is comfortably distributed on the wearers shoulders. The ends of the shoulder straps 46, 48 are preferably attached to the shoulder tabs 16, 18 by stitching or by other suitable means, such as riveting. The other ends of the shoulder straps include buckles 50, 52 which cooperate with and fasten to flexible straps 54, 56 attached to the waist tabs 20, 22. The straps 54, 56 can similarly be attached to the waist tabs 20, 22 by stitching or other suitable means, such as riveting. The straps 46, 48, 54, 56 fix the back pack about the shoulders of the wearer, while the buckles 50, 52 permit adjustment of the length of said straps so as to accommodate wearers of different size.

Attached to the two waist tabs 20, 22 respectively are a pair of flexible waist straps 58, 60. The waist straps 58, 60 can be attached to the waist tabs 20, 22 by stitching or by other suitable means, such as by riveting. Attached to one end of the waist strap 58 is a buckle 62 which cooperates with and fastens to one end of a flexible strap 64 which has its other end attached to one end of the other waist strap 60. The waist straps 58, 60 and strap 64 fix the back pack about the waist of the wearer, while the buckle 62 and strap 64 permits adjustment of the length of said straps so as to accommodate wearers of different size.

Additionally, it should be noted that the waist tabs 20, 22 and the straps 58, 60, 64 are fixed to the weight carrying member 14 at a point above the bottom and below the top of the weight member 36 when said member 36 is received in said first compartment 30.

Use of the present invention will now be considered. The zipper 34 is opened and the weight member 36 is removed from the first compartment 30. The cap 42 is removed from the neck opening 40 and the second compartment is filled with a desired amount of sand, such as ten pounds. The cap 42 is replaced on the neck opening 40, the weight member 36 is placed in the first compartment 30 and the zipper 34 is closed. The arms of the wearer 12 are inserted through the straps 46, 54 and 48, 56 and adjustment of the buckles 50, 52 is made so as to fit comfortably. The straps 58, 60 are placed about the wearer's 12 waist and the strap 64 is fastened and adjusted in the buckle 62 so as to fit the wearer comfortably. Physical exercises such as jogging, running, push ups and the like can then be done by the wearer without the back pack severely restricting his freedom of movement.

When exercising is finished, the buckles 50, 52, can be loosened, the buckle 62 and strap 64 disengaged and the back pack removed. The back pack can then be prepared for storage by opening the zipper 34, removing the weight member 36 from the first compartment 30, removing the cap 42 from the neck opening 40 and disposing of the weighting material 44 by emptying the sand from the second compartment. The cap 42 is then replaced on the neck opening 42, the weight member 36 is replaced in the first compartment 30 and the zipper 34 closed. The entire back pack can then be folded or rolled up to a minimum size for storage in a relatively small space. Additionally, the empty back pack will weigh only a small portion of its weight when filled with the weighting material so that it can be carried easily.

While this invention has been described in detail with particular reference to preferred embodiments thereof, it will be understood that variations and modifications can be effected within the spirit and scope of the invention as described hereinbefore and as defined in the appended claims.

I claim:

1. A collapsible physical training device to be worn by a person during physical exercise, said device comprising:

a flexible weight carrying member defining a first compartment, said member being adapted to be worn on said person's back, said weight carrying member further defining at least one opening into said first compartment and positioned at the bottom thereof;

means for closing said opening into said first compartment;

means for securing said weight carrying member about the shoulders of said person;

means for securing said weight carrying member about the waist of said person;

a flexible weight member defining a second compartment for containing a flexible and disposable weighting material, said weight member being adapted to be received within said first compartment, said weight member further defining at least one opening into said second compartment;

means for closing said opening into said second compartment; and means for dividing said second compartment into two or more communicating chambers.

2. The device of claim 1, wherein said waist securing means is attached to said weight carrying member at a point above the bottom but below the top of said weight member when said weight member is received in said first compartment.

3. The device of claim 1 further comprising a weighting material at least partially filling said second compartment.

4. The device of claim 3 wherein said weighting material is a solid, fluid material.

5. The device of claim 3, wherein said weighting material is a liquid.

6. The device of claim 1 wherein said shoulder securing means and said waist securing means are adjustable to different lengths to accomodate persons of different size and releasable to facilitate putting the device on and taking the device off.

* * * * *